US005135426A

United States Patent [19]

Lin

[11] Patent Number: 5,135,426

[45] Date of Patent: Aug. 4, 1992

[54] TOY STRINGED INSTRUMENT

[76] Inventor: Goang-Wen Lin, P.O. Box 10780, Taipei, Taiwan

[21] Appl. No.: 813,908

[22] Filed: Dec. 23, 1991

[51] Int. Cl.[5] ..... A63H 5/00

[52] U.S. Cl. ..... 446/408; 446/397; 446/484

[58] Field of Search ..... 446/397, 404, 406, 408, 446/484; 84/600, 173, 274, 267

[56] References Cited

U.S. PATENT DOCUMENTS

| | | | |
|---|---|---|---|
| 3,153,364 | 10/1964 | Ryan | 446/408 X |
| 3,524,377 | 8/1967 | Desmond | 446/408 X |
| 3,555,166 | 1/1971 | Gasser | 84/600 |
| 3,808,733 | 5/1974 | Pipa | 446/408 |
| 4,088,050 | 5/1978 | Appel | 84/267 |
| 4,372,187 | 2/1983 | Berg | 84/1.16 |
| 4,981,457 | 1/1991 | Iimura et al. | 446/408 |
| 4,986,792 | 1/1991 | Chen | 446/404 X |

*Primary Examiner*—Robert A. Hafer
*Assistant Examiner*—Sam Rimell

[57] ABSTRACT

A toy including a plurality of strings arranged on the outside of the toy body. By touching two strings simultaneously, a touch switch inside the body may be triggered off to output a signal to a music integrated circuit which has a device for incontinuously outputting note signals. The signal transmitted by the touch switch activates the music integrated circuit to output only one note signal to release sound through a speaker, whereby the tempo of the music released is controlled by the player's speed of touching the strings.

5 Claims, 1 Drawing Sheet

TOY STRINGED INSTRUMENT

FIELD OF THE INVENTION

This invention relates generally to a toy stringed instrument, and particularly to a toy stringed instrument having a device which accommodates therein an integrated circuit for prestoring melodies, and which can release musical notes one by one, whereby the player may control the tempo of the stored melodies at will.

BACKGROUND OF THE INVENTION

Conventional toy stringed instruments are mostly uninteresting. Take the common toy guitar as an example. It tries to attract children by the variety in its shape or color, or the pattern on the guitar. Some improved toy guitars are provided with several strings which produce sounds when the player strums. Unfortunately, these sounds are usually discordant and can hardly appeal to children, not to say enhancing the fun in playing toy stringed instruments.

Although integrated circuits are also used in some kind of toys to give more fun in playing, the use of integrated circuits in toy stringed instruments so as to enable the player to control the tempo of the stored melodies is unprecedented.

SUMMARY OF THE INVENTION

The primary object of the present invention is to provide a toy stringed instrument which can release sounds when the player touches two strings simultaneously with his hand or a conductive means.

Another object of the present invention is to provide a toy stringed instrument accommodating a music integrated circuit having a device for outputting incontinuous note signals, so that every time when two strings are touched simultaneously, a specific note of a stored melody is released; hence the player may control the tempo of the melody.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
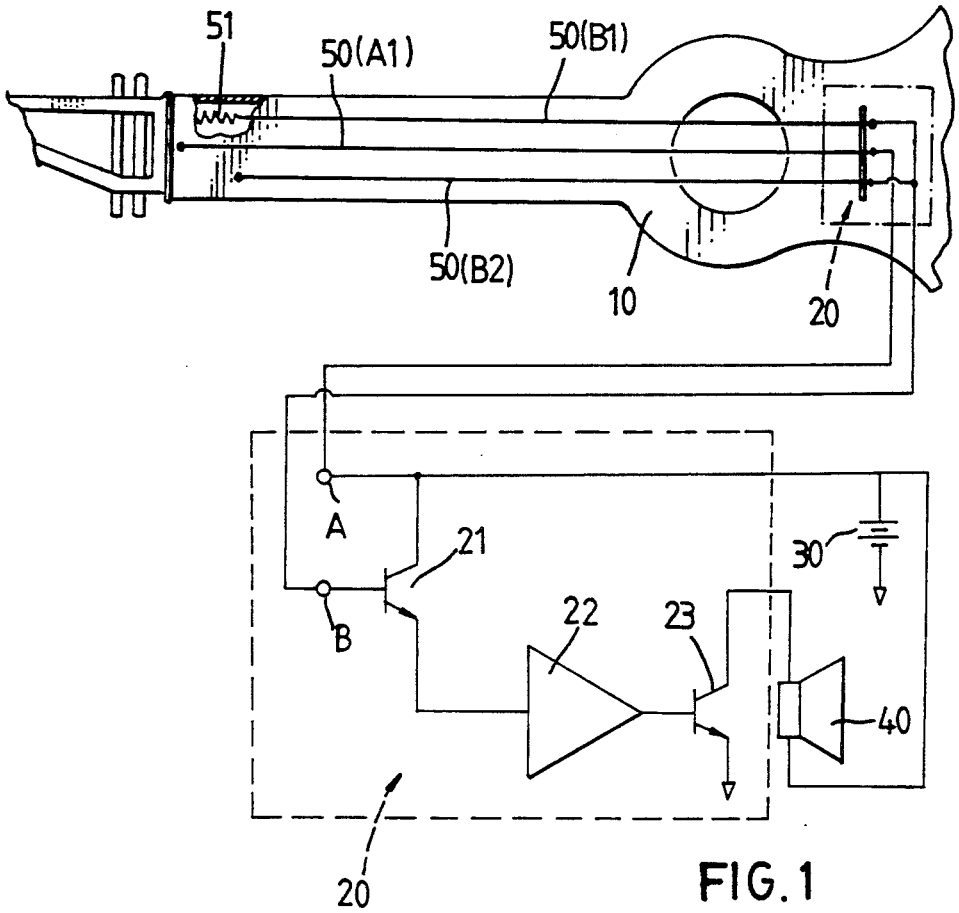
FIG. 1 is a schematic view of a preferred embodiment of the present invention, including a circuit diagram.

As shown in the drawings, the toy stringed instrument according to the present invention comprises a main body 10, whose shape is preferably that of a guitar or violin; a circuit device 20 fixed within the main body 10; a power source device 30, whether D/C or A/C, for supplying power to the circuit device 20; and a speaker 40 connected to the output end of the circuit device 20.

The main body 10 is provided with a plurality of strings 50, at least two, preferably three, in order to provide more fun in playing (to be described hereinafter).

The above-mentioned circuit device 20 includes a touch switch 21 having a first terminal A and a second terminal B. The signal output end of the touch switch 21 is connected to a music integrated circuit (IC) 22, the output end thereof being connected to the speaker via an amplifier 23.

The music IC 22 in the circuit device 20 prestores melodies for incontinuous release, that is, whenever two strings are touched simultaneously, only one of the musical notes in a stored melody is released. Supposing the stored melody is CEG, then the first touch will release the note C, the second touch the note E, the third touch the note G, and the fourth touch may release the note C again or the first note of another stored melody.

Therefore, the tempo of the stored melodies is determined by the touch switch 21, and not the music IC 22; in other words, the player may control the tempo of the stored melodies.

The above-mentioned strings 50 on the main body 10 are conductors. As shown in the drawings, the three strings are referred to as A1, B1, and B2. A1 is connected to the first terminal A of the touch switch 21, and B1 and B2 are connected to the second terminal B of the touch switch 21. Whenever strings A1 and B1, or A1 and B2, are touched simultaneously, the touch switch 21 will send a signal to the music IC 22 to cause it to release a note.

Figure 2:
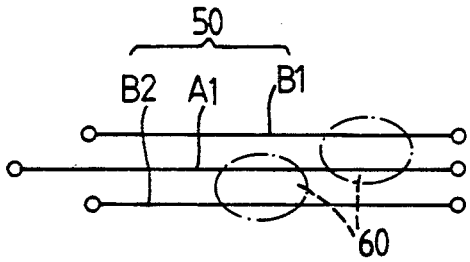
FIG. 2 is an illustration of playing the toy stringed instrument of the present invention.

FIG. 2 shows a preferred embodiment of the present invention, wherein, string A1 is arranged between strings B1 and B2. When a finger 60 simultaneously presses strings B1 and A1, or strings B2 and A1, because of the finger 60 acting as a conductive means, a musical note of a stored melody is released.

Figure 3:
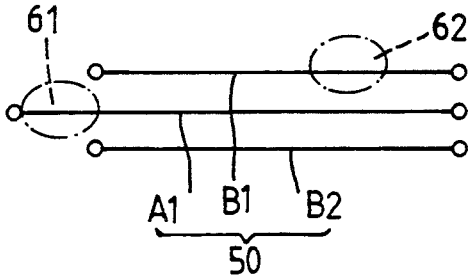
FIG. 3 is another illustration of playing the toy stringed instrument according to the present invention.

FIG. 3 shows another preferred embodiment of the present invention. When the player presses the string A1 with his/her left hand 61 and touches strings B1 or B2 with his/her right hand 62, because of the human body acting as a conductive means, a musical note of a stored melody is released.

Hence, the speed and tempo of the melodies as released by the music IC 22 may be controlled by the speed and tempo of the player's touching the strings, and this gives the player more fun in playing the toy stringed instrument of the present invention.

Reference is now made to FIG. 1. The first end of each of the strings 50 is fixed, while the second end thereof is connected to a resilient member 51, such as an extension spring, so as to prevent the strings 50 from breaking as a result of metal fatigue caused by great pressure. furthermore, the music IC 22 may store a number of melodies, and one of which be selected before playing by means of a select switch. Or, the shortest time for imputting two continuous signals may be preset in the music IC 22 as a control value; when the time interval between the latter input signal and the former input signal exceeds the preset control value, the toy stringed instrument according to the present invention will jump to the first note of a certain melody; in this way, the player may be forced to be more attentive in playing.

It should be understood that the above illustration is a description of the various modifications of the music IC 22 used in the present invention, and which should not be taken as the focus of the present invention.

Although the present invention has been illustrated and described with reference to the preferred embodiments thereof, it should be understood that it is in no way limited to the details of such embodiments, but is capable of numerous modifications within the scope of the appended claims.

What is claimed is:

1. A toy stringed instrument comprising:

a main body;

a circuit device fixed inside said body;

a power source device for supplying power to said circuit device;

a speaker connected to said circuit device; and at least two conductive strings mounted on said main body, the first end of each of said strings being fixed in said main body, and the other end of each of said strings being connected to said circuit device, wherein said circuit device comprises a music integrated circuit for incontinuously outputting note signals, said music integrated circuit connecting a touch switch which, when "ON", transmits a signal to said music integrated circuit to cause said music integrated circuit to output one note signal at a time releasing a musical note via said speaker;

said touch switch having two terminals, the first terminal being connected to one of said strings, the second terminal being connected to the other of said strings.

2. A toy stringed instrument as claimed in claim 1, wherein the first end of each of said strings is connected to said main body by means of a resilient member.

3. A toy stringed instrument as claimed in claim 1, wherein three strings are provided on said main body and said first terminal of said touch switch is connected to the middle string.

4. A toy stringed instrument as claimed in claim 1 wherein the shape of said main body is that of a guitar.

5. A toy stringed instrument as claimed in claim 1 wherein the shape of said main body is that of a violin.

* * * * *